US006701596B2

(12) United States Patent
Kloepfer et al.

(10) Patent No.: US 6,701,596 B2
(45) Date of Patent: Mar. 9, 2004

(54) CLAMPING AND SPREADING DEVICE FOR THE RELATIVE MOVEMENT OF TWO WORKPIECES

(75) Inventors: Gerhard Kloepfer, Pleidelsheim (DE); Karl Philipp, Bietigheim-Bissingen (DE)

(73) Assignee: Bessey & Sohn GmbH & Co., Bietigheim-Bissingen (DE)

( * ) Notice: Subject to any disclaimer, the term of this patent is extended or adjusted under 35 U.S.C. 154(b) by 20 days.

(21) Appl. No.: 10/035,673

(22) Filed: Dec. 28, 2001

(65) Prior Publication Data

US 2003/0034601 A1 Feb. 20, 2003

(30) Foreign Application Priority Data

Aug. 17, 2001 (DE) ..... 101 41 153

(51) Int. Cl.[7] ..... E04F 21/22

(52) U.S. Cl. ..... 29/281.5; 29/238; 29/239; 29/266; 269/21; 269/43; 269/37; 254/13

(58) Field of Search ..... 269/21, 43, 37, 269/259, 260; 29/281.5, 238, 266, 239; 228/44.5, 49.3; 254/13

(56) References Cited

U.S. PATENT DOCUMENTS 731,665 A * 6/1903 Clayton ..... 269/43
1,942,463 A * 1/1934 Williams ..... 269/43
2,734,410 A * 2/1956 Gipperich ..... 269/252
2,907,238 A * 10/1959 White ..... 269/252
3,711,920 A * 1/1973 Simmons, Jr. ..... 269/43
4,750,662 A * 6/1988 Kagimoto ..... 269/43
4,769,889 A * 9/1988 Landman et al. ..... 269/43
5,340,095 A * 8/1994 Eicher, III ..... 269/43
5,733,046 A * 3/1998 Bellmore et al. ..... 384/37
5,894,705 A * 4/1999 Sutton ..... 269/21

* cited by examiner

*Primary Examiner*—Robert C. Watson
(74) *Attorney, Agent, or Firm*—Barry R. Lipsitz; Douglas M. McAllister

(57) ABSTRACT

In order to improve a clamping and spreading device for the relative movement of two workpieces which have surfaces lying essentially parallel to a common plane, comprising a first holder, to which the first workpiece can be fixed, and a second holder, to which the second workpiece can be fixed, wherein the two holders are movable relative to one another, in such a manner that this can be used in a simple manner comfortable for the operator it is provided for the first holder and the second holder to be connected to one another via a guiding device so as to be displaceable and for the guiding device to comprise an actuating element which is mounted not only on the first holder so as to be movable but is also mounted on the second holder so as to be movable and via which a relative movement of the two holders can be actuated.

30 Claims, 6 Drawing Sheets

CLAMPING AND SPREADING DEVICE FOR THE RELATIVE MOVEMENT OF TWO WORKPIECES

The present disclosure relates to the subject matter disclosed in German Application No. 101 41 153.7 of Aug. 17, 2001, which is incorporated herein by reference in its entirety and for all purposes.

BACKGROUND OF THE INVENTION

The invention relates to a clamping and spreading device for the relative movement of two workpieces which have surfaces lying essentially parallel to a common plane, comprising a first holder, on which the first workpiece can be fixed, and a second holder, on which the second workpiece can be fixed, wherein the two holders are movable relative to one another.

Such a device is sold, for example, under the name VERIFIX by the Josef Bohle Stiftung & Co. KG, Haan, Germany. Furthermore, such a device is known by the name "Rigid Seaming Vacuum Pads" from Pinske Edge, Plato, Minn., USA.

The object underlying the invention is to improve a clamping and spreading device specified at the outset in such a manner that this can be used in a simple manner comfortable for the operator.

SUMMARY OF THE INVENTION

This object is accomplished in accordance with the invention in that the first holder and the second holder are connected to one another via a guiding device so as to be displaceable and that the guiding device comprises an actuating element which is not only mounted on the first holder so as to be movable but is also mounted on the second holder so as to be movable and via which a relative movement of the two holders can be actuated.

Due to the fact that the two holders are connected to one another via the guiding device and, in addition, via the actuating element of the guiding device which is, in particular, of a rigid design, a relative movement between the two holders and, therefore, between respective fixed workpieces may be carried out in a concerted and simple manner in order to bring about, in particular, a clamping movement or a spreading movement. A good stability and rigidity of the device is achieved by the coupling of the two holders via the guiding device so that, in particular, any tilting of the two workpieces relative to one another can be prevented to a large extent.

A large path of displacement of the two holders relative to one another may be brought about via the movable mounting of the actuating element not only on the first holder but also on the second holder without the outer dimensions needing to be increased significantly as a result.

In this respect, it is provided, in particular, for the actuating element to be mounted on the first holder so as to be rotatable or rotatably displaceable relative to it. A corresponding moment may be exerted as a result of rotation in order to be able to act on the two holders with a force relative to one another in order to be able to carry out a clamping procedure or a spreading procedure as a result.

Furthermore, it is provided for the actuating element to be mounted on the second holder so as to be rotatably displaceable relative to it. The second holder is then displaced relative to the actuating element via a rotation of the actuating element and, therefore, the two holders may be displaced relative to one another. If the actuating element is also held on the first holder so as to be rotatably displaceable, a translational movement not only of the first holder but also of the second holder takes place during a rotation of the actuating element. If the actuating element is mounted so as to only be rotatable with respect to the first holder, no translational movement takes place in relation to it.

As a result of rotary actuation of the actuating element, the second holder may be favorably moved towards the first holder or away from the first holder depending on the direction of rotation. In this respect, it may also be provided for the first holder to itself move in a translational manner with respect to the actuating element.

It is particularly advantageous when the distance between the two holders can be adjusted infinitely via the actuating element in order to thus be able to set any optional distance and in order to facilitate constant action with a force during a clamping movement or spreading movement.

Furthermore, it is favorable when a specific distance between the two holders is determined via a specific position of the actuating element. As a result, a specific position need not be maintained by the actuating element being acted upon from outside with a force but rather a set distance between the two holders also remains fixed without any external action with a force.

In one embodiment which can be used in a simple manner, the actuating element comprises a spindle which is, in particular, of a rigid design and extends between the two holders.

In this respect, the spindle is, in particular, rotatably mounted so as to be non-translational with respect to the first holder. It is then sufficient to provide only one rotary sliding bearing, for example, via threads engaging in one another and, in particular, no oppositely directed threads need be provided in order to bring about a relative movement of the two holders via a rotation of the spindle.

In an alternative embodiment, the actuating element comprises a sleeve which is arranged so as to be rotatable on one holder or between the two holders and in relation to which at least one holder is displaceable. Such a sleeve may also be arranged between the holders in order to obtain a particularly space-saving design. As for the rest, such a device may also be designed with great symmetry, i.e. the actuating element may be arranged in a plane of symmetry in order to minimize any tilting moment of the entire device.

In this respect, it is particularly provided for the holder or holders, with respect to which the sleeve is arranged so as to be rotatable, to have a respective, non-rotatable spindle for engaging the sleeve. A relative displacement of the holders towards one another or away from one another may then be achieved via actuation and, in particular, rotation of the sleeve as a result of the combination spindle/sleeve and with formation of a rotary sliding bearing, in particular, via threads engaging in one another.

The actuating element is advantageously provided with at least one threaded section which engages in a corresponding threaded section of an associated holder for the displaceable guidance of this holder. As a result, a rotary sliding bearing may be formed in a technically simple manner and so a rotary movement of the actuating element can be converted into a translational movement, wherein a clamping force or spreading force can be exerted on workpieces via torque on the actuating element.

In this respect, at least the second holder is favorably provided with an internal thread for engaging in an external thread of the actuating element in order to be able to displace the second holder in relation to the first holder by forming a corresponding rotary sliding bearing. In this respect, it may be provided for the first holder to also be provided with a rotary sliding bearing in order to be able to displace not only the first holder but also the second holder in relation to it in a translational manner during rotation of the actuating element.

It is particularly advantageous when the actuating element is provided with a handle. Such a handle, such as, for example, a wooden handle which sits well in the hand, may be grasped by an operator with one hand so that the operator can get a good grip on it and thus can exert a high torque on the actuating element and, therefore, can exert a correspondingly high clamping force or spreading force on workpieces.

In a variation of one embodiment, the handle is arranged at one end of the actuating element outside an intermediate area between the two holders so that unhindered engagement on the handle is possible.

In an alternative embodiment, the handle is arranged in the intermediate area between the two holders. As a result, the outer dimensions of the device are minimized and, in addition, a symmetric construction may be achieved, by means of which tilting moments of the device are, for example, minimized in relation to workpieces.

It is provided, in particular, for a first threaded section of the first holder or the actuating element and a second threaded section of the second holder or the actuating element to be designed such that the two holders are displaceable relative to one another during rotation of the actuating element. During a rotary actuation of the actuating element, not only the first holder but also the second holder are moved in a translational manner, namely towards one another in order to generate, for example, a clamping force or away from one another in order to generate, for example, a spreading force. A corresponding threaded design may be achieved by way of oppositely directed threaded sections or ones with different pitches.

It is particularly advantageous when the guiding device comprises at least two spaced guide rails, via which the two holders are guided for displacement relative to one another. As a result, a high stability of the device is achieved since the two holders are coupled to one another several times, namely via the actuating element and the two guide rails. As a result, a levering moment, with which the device engages on workpieces, is minimized. Furthermore, an operator can exert a force on two workpieces in a simple and secure manner, for example, a clamping force and a spreading force, namely in a largely symmetric manner in order to keep troublesome tilting moments of the device in relation to the workpieces small.

In this respect, a guide rail is advantageously provided with an end stop in order to prevent any detachment of a holder from the device.

An inventive device may be produced in a simple and inexpensive way when the first holder and the second holder each have a guide bracket, on which the guide rails are guided or fixed. As a result, the guidance of the two holders may be designed separately from the holding function of the two holders. For example, the holders may be magnetic holders, vacuum suction means or holders which can be fixed on a workpiece in a form-locking, frictional or adhesive manner. In order to form a guiding device, these holders do not have to be substantially modified and, in particular, their holding function is not affected by the design of a guiding device. In addition, certain dimensions which are advantageous for the functioning of the device may be modified as a result of a separate formation of guide brackets. For example, the guide rails may be "lowered" via the guide brackets in order to, in particular, keep the lever arm of the guide rails and thus of the entire device slight in relation to workpieces.

In this respect, the guide brackets of the two holders are advantageously of essentially the same design in order to keep the production costs low.

Furthermore, it is advantageous when a guide bracket is designed with respect to its outer configuration to be essentially symmetric to a longitudinal axis of the device. As a result, tilting moments of the device are minimized in relation to a workpiece.

Furthermore, it is advantageous when a guide bracket is designed such that the guide rails are located beneath the actuating element with respect to a holding plane facing the workpiece surface. In this way, the lever arm of the device, which is present in relation to a workpiece surface, is reduced.

In a particularly advantageous variation of one embodiment, a spindle is mounted as actuating element on the first guide bracket of the first holder and the second guide bracket of the second holder. The spindle is, in particular, mounted on the first guide bracket so as to be rotatable and mounted on the second guide bracket so as to be rotatably displaceable.

With such an embodiment, it is, in addition, favorable when the guide rails are fixed on the first holder so that during a rotary actuation of the spindle only the second holder is displaced in relation to the spindle via the guide bracket.

In order to be able to minimize the lever arm of the device in relation to workpieces, the spaced guide rails are favorably arranged in the area of a transverse end of a guide bracket.

Furthermore, it is favorable when the actuating element is mounted between the guide rails parallel to them in order to, on the one hand, reduce the production costs and, on the other hand, achieve a good and stable coupling between the two holders.

In a variation of one embodiment, a lever for compensating for differences in the levels of the workpieces is guided for displacement on a guide rail. When two workpieces, for example, two plates are clamped to one another by means of the inventive device, it is possible that in the area of the join small differences in levels are present, i.e. the plates do not lie exactly flush in this area. Such small differences in levels may be compensated at the join transition with such a lever which presses on the plates in the area where they join.

For this purpose, the lever is, in particular, pivotable with a contact surface in the direction of the surface of the workpieces so that a slight tilting of the two workpieces relative to one another can be brought about as required via the contact surface in order to obtain a flush transition via a join.

Furthermore, it is favorable when the contact surface is essentially located on a plane defined by the two holders in a compensation position of the lever in order to obtain a flush adjustment.

It is, furthermore, favorable when the lever has a free space on its contact surface. This free space can accommodate glue when the two workpieces are intended to be adhered or glued via the join. Furthermore, it is possible via this free space to supply adhesive material or glue to the join, for example, from above without the lever needing to be released.

It may be favorable when the guiding device is biased to reduce the guidance play, for example, in that the guide rails are bent. This has functional advantages since the corresponding bearings need to be of a less exact design and, nevertheless, a high clamping force or spreading force can be achieved.

With the inventive device, the most varied of holders can be used. In the case of magnetic materials, magnetic holders can, for example, be used. It may also be provided for the holder to comprise a block which is screwed, for example, to a workpiece. Particularly for plate-like components with a smooth surface, it is advantageous when the holder comprises a vacuum suction device which can adhere securely to a workpiece via underpressure.

The following description of preferred embodiments serves to explain the invention in greater detail in conjunction with the drawings.

DETAILED DESCRIPTION OF THE INVENTION

Figure 1:
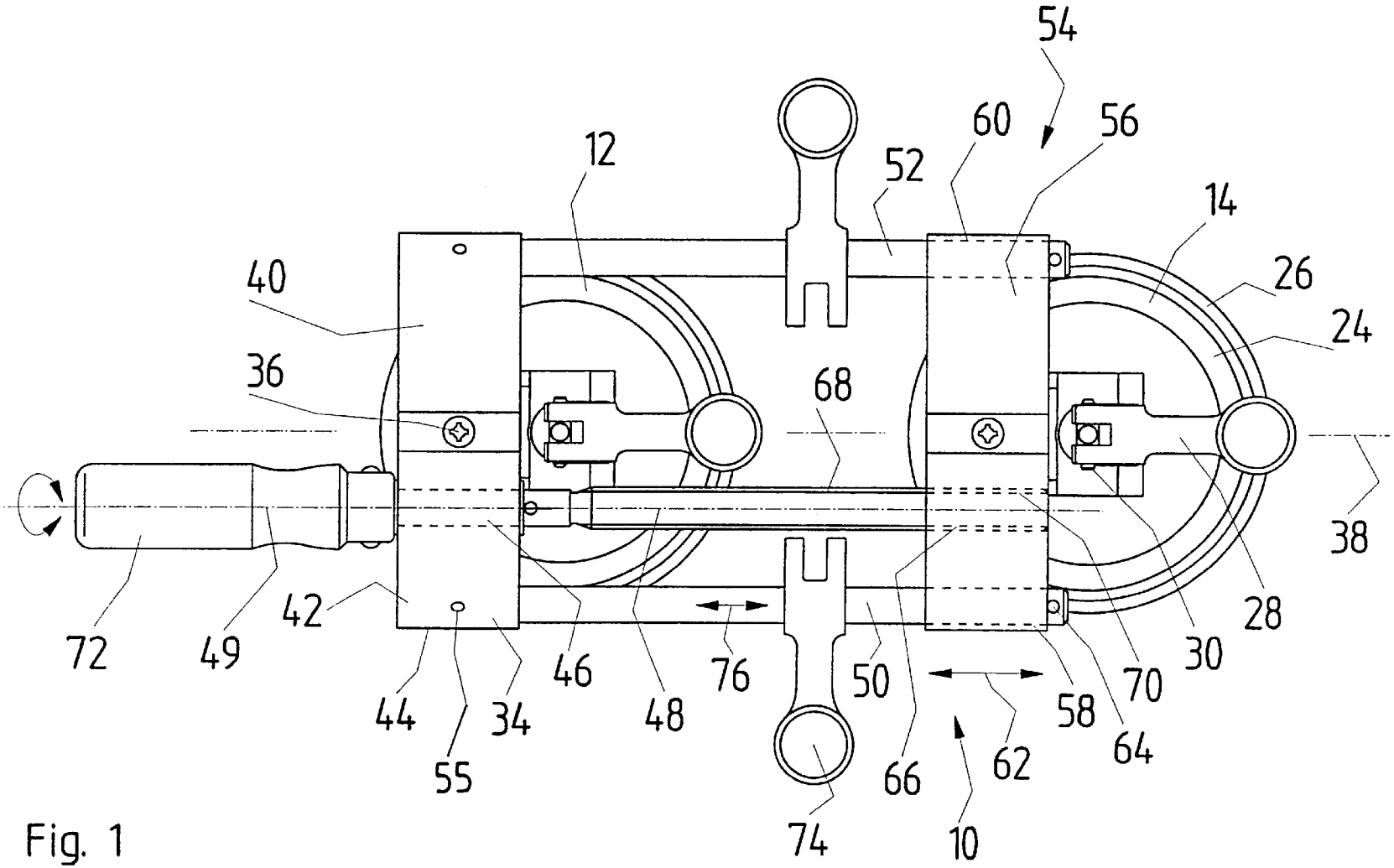
FIG. 1 shows a plan view of a first embodiment of an inventive clamping and spreading device.

An inventive clamping and spreading device, of which a first embodiment is shown in FIGS. 1 to 4 and designated in these Figures as a whole as 10, comprises a first holder 12 and a second holder 14, wherein a holder 12, 14 may be fixed on a respective workpiece 16, 18 (FIGS. 2 to 4) and may be fixed, in particular, on a surface of the respective workpiece 16, 18. A corresponding holding surface 20 of the first holder 12 facing the workpiece 16 is thereby located essentially in the same plane as the corresponding holding surface 22 of the second holder 14.

The holders 12, 14, which are, in particular, of the same constructional design, can, for example, be magnetic holders when magnetic workpieces 16, 18 are intended to be processed.

In the embodiment shown, the holders 12, 14 are designed as vacuum suction means, with the aid of which workpieces 16, 18 with smooth surfaces may also be clamped or spread relative to one another. Such a vacuum suction means, which is known per se, has a bowl 24 with a cavity. This cavity is covered opposite a workpiece 16 by a disk 26 consisting of an elastic material, wherein this disk 26 can be drawn at least partially into the cavity but leaves the edges of the disk 26 covered in an air-tight manner opposite the workpiece 16. A lever 28 is provided for drawing the disk 26 into the cavity and is pivotable, in particular, about a pivot shaft 30.

Figure 2:
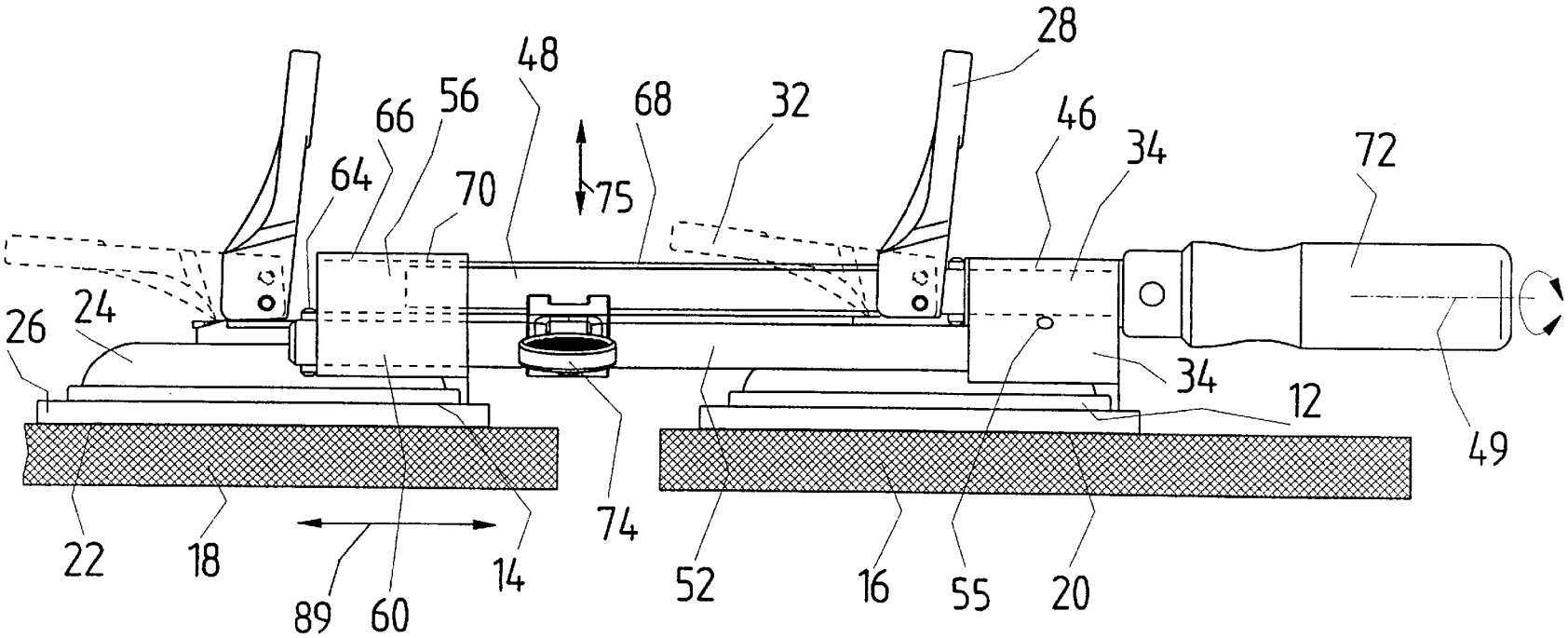
FIG. 2 shows a side view of the device according to FIG. 1, wherein a first holder and a second holder of the device hold respective workpieces.
Figure 3:
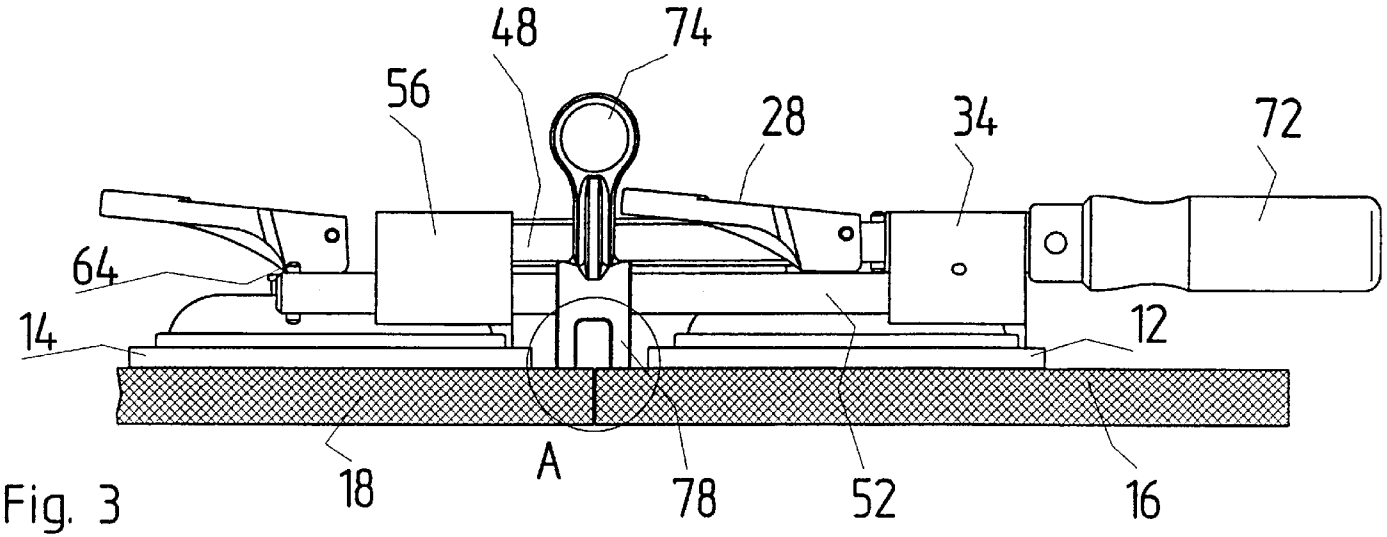
FIG. 3 shows a side view similar to FIG. 2, wherein the two workpieces have been pushed towards one another by means of the inventive device.
Figure 4:
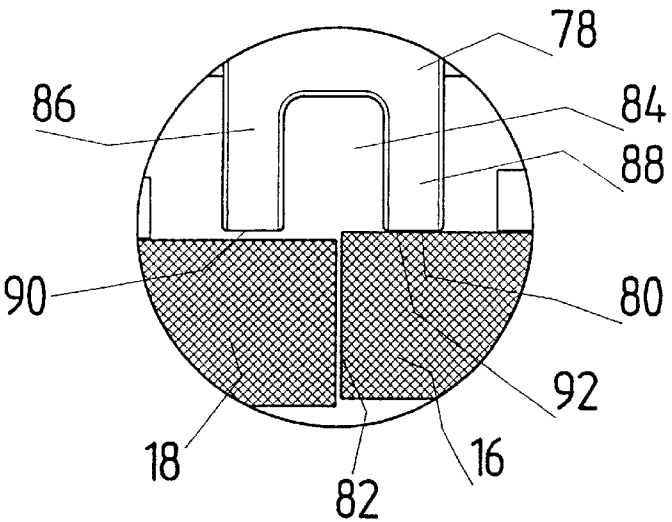
FIG. 4 shows an enlarged view of section A in FIG. 3.

In order to fix a vacuum suction means to a workpiece 16, the bowl 24 is placed in position with the disk 26 with a lever 28 open (FIG. 2). Only a very slight space filled with air then remains between the disk 26 and the surface of the workpiece 16. If the lever 28 is now shifted (shown in FIG. 2 with the reference numeral 32 in broken lines) and, as a result, the disk 26 is moved in the direction of the cavity, wherein the disk 26, which has a greater diameter than the bowl 24 at the contact area of the disk 26, seals the area between the workpiece 16 and an edge of the disk 26 essentially in an air-tight manner, the volume of the space between the disk 26 and the workpiece 16 between the edges mentioned is increased, whereby the pressure decreases. This is therefore less than the air pressure and the bowl 24 with the disk 26 adheres to the workpiece surface by way of suction as a result.

A first guide bracket 34 is seated on the first holder 12 and this is, for example, produced from a cold-drawn, profiled aluminum section. This first guide bracket 34 is rigidly connected to the first holder 12, for example, via a screw connection 36. A transverse dimension of the first guide bracket 34 transversely to a longitudinal axis 38 of the clamping and spreading device 10 is thereby greater than a corresponding transverse dimension of the first holder 12. In relation to this longitudinal axis 38, the first guide bracket 34 is essentially of a symmetric design.

The first guide bracket 34 is designed such that a central area 40, via which the first guide bracket 34 is fixed on the first holder 12, is located higher, in relation to the holding surface 20, than an outer area 42 and, in particular, a (preferably rounded) transverse edge 44.

A rotary bearing 46 for a spindle 48 as actuating element for a relative displacement of the two holders 12 and 14 is arranged in the first guide bracket 34. In order not to hinder any pivoting movement of the levers 28 of the vacuum suction means as holders 12, 14, the rotary bearing 46 is placed off-center, i.e. is offset in relation to the longitudinal axis 38. The spindle 48 can be rotated on the first holder 12 about an axis of rotation 49 parallel to the longitudinal axis.

A first guide rail 50 and a second guide rail 52 are arranged on the first guide bracket 34 parallel to the longitudinal axis 38 in the respective area of the left and right transverse edges 44. Such a guide rail is secured on the first guide bracket 34, for example, by means of a holding pin 55 so as to be non-rotatable and non-displaceable. A guide rail 50, 52 is designed, in particular, in the form of a round bar which is, for example, produced by cold drawing.

A plane formed by the two guide rails 50 and 52 is essentially parallel to the holding surface 20 and 22, respectively, of the two holders 12 and 14. The distance from the guide rails 50, 52 to the holding surfaces 20, 22 is less than the distance from the spindle 48 in order to thus ensure a small lever arm during the clamping or spreading of two workpieces 16, 18 relative to one another; the first guide bracket is, to a certain extent, lowered in the area where the guide rails 50, 52 are fixed in position.

In order to guide the second holder 14 relative to the first holder 12, a guiding device designated as a whole as 54 comprises, in addition, a second guide bracket 56 which is, in principle, of the same design as the first guide bracket 34, wherein the second guide bracket 56 is fixed in relation to the second holder 14. In this respect, the second guide bracket 56 is, in particular, aligned essentially flush with the first guide bracket 34.

The second guide bracket 56 has for the first guide rail 50 and for the second guide rail 52 respective sliding bearings 58 and 60, via which the second holder 14 can be displaced towards the first holder 12 or away from it in a direction of displacement 62 parallel to the longitudinal axis 38. Such a sliding bearing is formed, in particular, by a corresponding recess (in the case of a cylindrical guide rail 50, 52 a cylindrical recess).

A guide rail 50, 52 is provided with an end stop 64 which is formed, for example, by a pin projecting above a surface of the guide rail 50, 52 in order to prevent the second guide bracket 56 from separating from the guide rails 50 and 52 during a displacement of the second holder 14 away from the first holder 12.

Furthermore, a rotary sliding bearing 66 is formed in the second guide bracket 56, aligned flush with the rotary bearing 46, and this accommodates the spindle 48. The spindle 48 extends continuously from the first holder 12 via its first guide bracket 34 to the second holder 14 via its second guide bracket 56 and, as a result, connects the two holders 12 and 14. The spindle 48 is mounted on the first holder 12 so as to be movable, namely rotatable, via the rotary bearing 46 and is held on the second holder 14 so as to likewise be movable but rotatably displaceable in relation to it. Since the spindle 48 is, therefore, held so as to be non-displaceable in relation to the first holder 12, a relative movement of the second holder 14 in relation to the first holder 12 may be generated via the rotary sliding bearing 66.

For this purpose, the spindle 48 is provided with an external thread 68, for example, with a trapezoidal thread which is produced rolled and cold-worked and is, in particular, wear-resistant. The rotary sliding bearing 66 is formed by a corresponding internal thread 70 which is arranged in the second guide bracket 56 and in which the spindle 48 engages with its external thread 68. By turning the spindle 48, the second guide bracket 56 and with it the second holder 14 are displaced as a result, wherein the direction of displacement 62 is determined depending on the direction of rotation.

As a result of the external thread 68 engaging in the internal thread 70, any distance between the first holder 12 and the second holder 14 can be adjusted infinitely, wherein a specific distance is ensured, i.e. is set securely at a specific rotary position of the spindle 48 and can only be altered due to rotation of the spindle 48 itself.

In order to exert torque, the spindle 48 is provided with a handle 72 which can be grasped, in particular, by a grip hand. For example, a wooden handle which sits well in the hand is provided and this is riveted to the spindle 48.

The handle 72 is arranged in the first embodiment 10 at an end of the spindle 48 which is located opposite the internal thread 70 so that the handle 72 is seated outside the intermediate space between the two guide brackets 34 and 56 and, therefore, the displacement of the second holder 14 relative to the first holder 12 can be actuated from outside and is thus easily accessible.

The first guide bracket 34 is arranged on the first holder 12 such that the grippability and the rotatability of the handle 12 are essentially not hindered by it.

A respective lever 74 is seated on the guide rails 50 and 52 and serves to compensate for differences in the levels of the workpieces 16 and 18. The lever 74 is displaceable relative to the first holder 12 in a direction of displacement 76 parallel to the direction of displacement 62 and so it can be displaced, in principle, into any optional position on the associated guide rail (for example, guide rail 50). The lever 74 is mounted on the associated guide rail 50, 52 so as to be rotatable (indicated in FIG. 2 by the reference numeral 75), i.e. the guide rail 50, 52 represents a rotary shaft for the lever 74.

The lever 74 is provided with a contact element 78 (FIGS. 3, 4) which has a contact surface 80, with which the contact element 78 can be abutted on a workpiece surface of the workpiece 16 and 18. The contact surface 80 can be pivoted towards the workpieces 16, 18 due to pivoting of the lever 74 on the associated guide rail 50 and 52, respectively, so that the contact surface 80 can be abutted on one workpiece 16 or 18 or on both workpieces 16 and 18. If the contact surface 80 is thereby placed over a join 82 of the two workpieces 16 and 18, a level compensation may be carried out, i.e. the flush connection of the workpiece surfaces in the area of the join 82 can be improved. Workpieces may also be moved somewhat during the pivoting movement of the lever 74 via its lever action.

The contact element 78 has in the area of its contact surface 80 a free space 84 which is formed between a first arm 86 and a second arm 88 of the contact element 78, wherein an end face 90 of the first arm 86 and an end face 92 of the second arm 88 form the contact surface 80.

This free space 84 can accommodate, for example, adhesive remains or glue residues which are pressed through in the direction of the contact element 78 during adhesion of the two workpieces 16 and 18 at the join 82 or the join 82 may be acted upon with, for example, adhesive or glue from the upper side of the workpieces 16 and 18 via the free space 84.

The inventive clamping and spreading device operates as follows:

It is placed on the workpieces 16 and 18 in that the first holder 12 is placed on the workpiece 16 and the second holder 14 on the workpiece 18. By shifting the lever through 90° into the position 32 (FIG. 2) the two vacuum suction means 12 and 14 adhere firmly to the respective workpieces 16 and 18 by way of suction. As a result of rotation of the spindle 48 the second holder 14 may be displaced relative to the first holder 12, wherein the direction of displacement 62 is determined by the rotational direction of the rotation which is conveyed via the handle 72. When the second holder 14 is moved away from the first holder 12, the workpiece 18 is moved away from the workpiece 16, i.e. a spreading movement is carried out. If the second holder 14 is moved towards the first holder 12, a clamping movement is carried out. The directions of movement of the workpieces 16 and 18 are indicated in FIG. 2 by the reference numeral 89.

Any differences in levels at a join 82 between the two workpieces 16 and 18 may be compensated via the lever 74 in order to bring about a better flush connection of the two workpieces 16 and 18 which are, in particular, plate-like workpieces.

Due to the fact that the guide rails 50 and 52 have a smaller vertical distance from the workpieces 16 and 18 than the spindle 48, the lever arm of the clamping and spreading device 10 is minimized in relation to the workpieces 16 and 18 in the case of a simple rotatability of the spindle 48, i.e. simple actuatability of the relative displacement of the two holders 12 and 14. Such a "lowering" of the guide rails 50 and 52 (and, therefore, the point of gravity of the device, as well) improves the flush alignments of the workpieces 16 and 18 at a join 82. Moreover, an additional level compensation may be achieved.

The largest possible distance which can be achieved between the two holders 12 and 14 is determined by the fact that the second guide bracket 56 butts against the end stops 64 of the guide rails 50 and 52. The smallest distance between the two holders 12 and 14 is determined by the fact that the disks 26 of the two holders 12 and 14 abut on one another.

To reduce the production costs by saving on material, it is therefore advantageous when the two guide brackets 34 and 56 are arranged on facing areas of the two holders 12 and 14. In the case of the arrangement shown in FIG. 1, the first guide bracket 34 is, however, arranged such that the handle 72 is easily accessible without needing to substantially increase the height of the guide brackets 34 and 56 in relation to the holding surfaces 20, 22.

It may be provided in accordance with the invention for the guiding device 54 to be biased in such a manner that the bearing clearance is reduced. As a result, the precision, in particular, of the sliding bearings 58 and 60 and also of the rotary sliding bearing 66 may be reduced and thus the production costs kept lower. Such a biasing is achieved, for example, in that the guide rails 50 and 52 are slightly bent, namely away from the holding surfaces 20 and 22, in particular.

Figure 5:
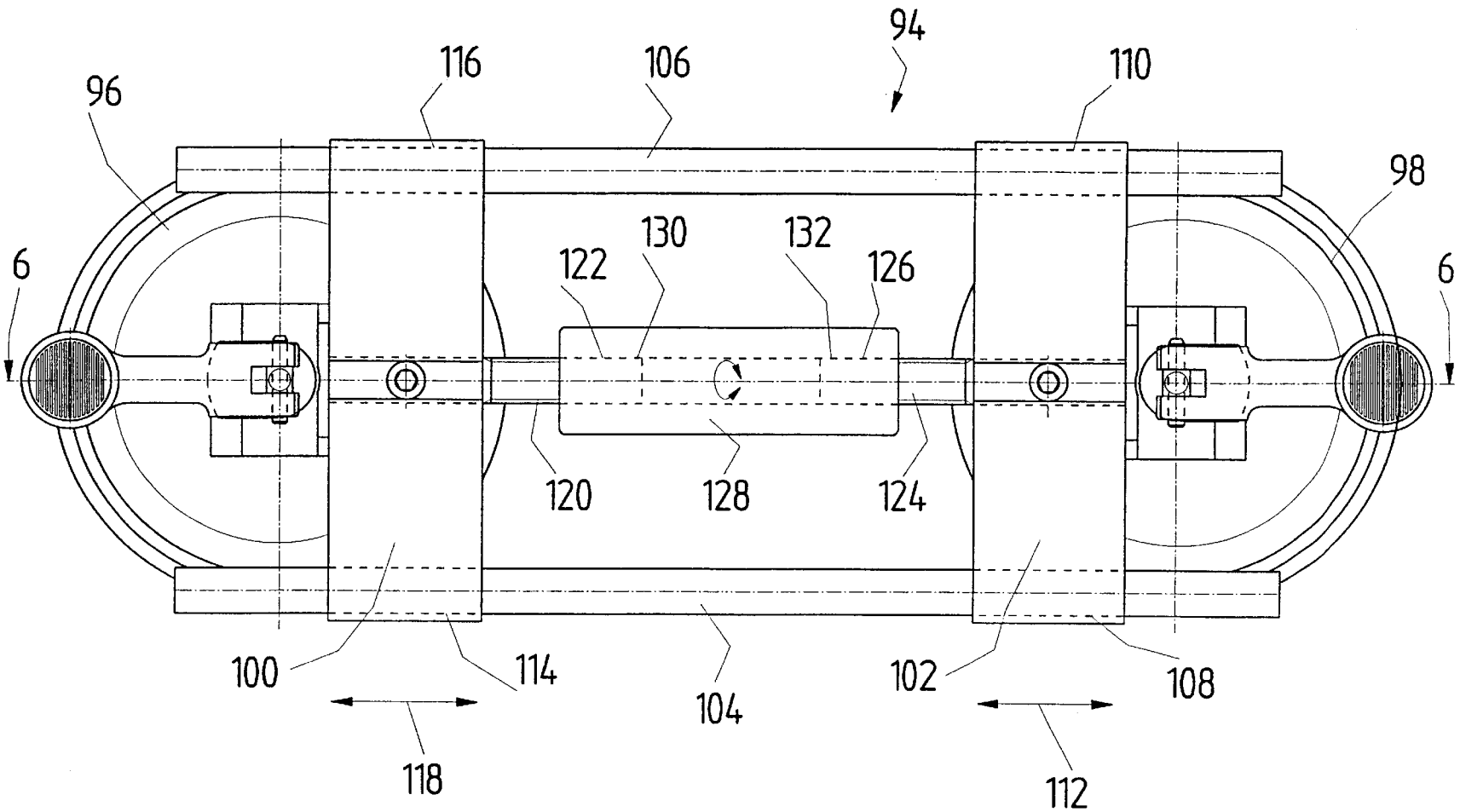
FIG. 5 shows a plan view of a second embodiment of an inventive clamping and spreading device.
Figure 6:
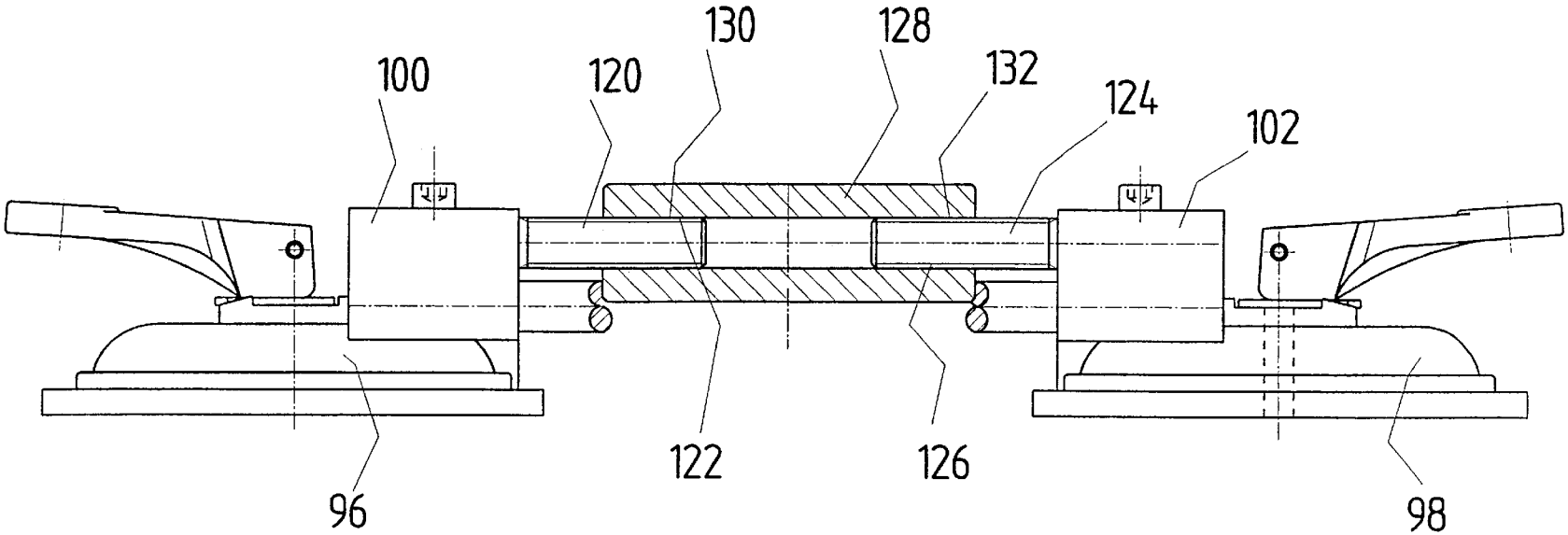
FIG. 6 shows a schematic sectional view along line 6—6 according to FIG. 5

In a second embodiment of an inventive clamping and spreading device, which is shown in FIGS. 5 and 6 and designated as a whole as 94, a first holder 96 and a second holder 98 are likewise provided and these are, in principle, of the same design as the holders 12 and 14 described above and also operate in the same way. A first guide bracket 100 is securely arranged on the first holder 96 and a second guide bracket 102 on the second holder 98. The two holders 96 and 98 are connected to a first guide rail 104 and a second guide rail 106 via the guide brackets 100 and 102 in a similar way to the first embodiment 10. The second guide bracket 102 has sliding bearings 108 and 110 for the guide rails 104 and 106 so that the second holder 98 is displaceable with the second guide bracket 102 relative to these guide rails 104 and 106, namely in a direction of displacement 112.

The first guide bracket 100 is of an identical design to the second guide bracket 102 and comprises, in particular, sliding bearings 114 and 116 for the guide rails 104 and 106 so that the first holder 96 is guided on the guide rails 104, 106 for displacement along them in a direction of displacement 118 which coincides with the direction of displacement 112.

A spindle 120 is non-rotatably arranged on the first guide bracket 100 facing the other guide bracket 102. This spindle 120 is provided with an external thread 122.

Symmetrically thereto, a spindle 124, which is likewise provided with an external thread 126 and is aligned flush with the spindle 120, is non-rotatably arranged on the second guide bracket 102 facing the other guide bracket 100.

A rotatable sleeve 128 is seated as actuating element between the two spindles 120 and 124 and this sleeve connects the two spindles 120 and 124 and, therefore, the two holders 96 and 98 to one another. The sleeve 128 has an internal thread 130 for engaging in the external thread 122 and an additional internal thread 132 for engaging in the external thread 126 of the spindle 124, wherein the pairs of threads 122, 130 and 126, 132 are designed such that during rotation in one direction an oppositely directed translational movement of the associated spindles 120 and 124 takes place, i.e. these are moved either towards one another or away from one another depending on the rotational movement.

In a variation of one embodiment it is provided for the sleeve 128 to be mounted on one holder so as to be rotatable but non-displaceable whereas it is mounted on the other holder, as described, so as to be rotatably displaceable.

The sleeve 128 is advantageously designed as a handle or provided with one so that a rotation of it is possible in a simple manner.

If the sleeve 128 is turned in one direction, this causes the two holders 96 and 98 to either be moved towards one another or be moved away from one another on account of the rotatably displaceable mounting of the spindles 120 and 124 in the sleeve 128, wherein both holders are moved, i.e. both carry out a relative translational movement with respect to the sleeve 128. In the case of a correspondingly symmetric configuration of the pairs of threads 122, 130 and 126, 132, the movement towards one another or the movement away from one another is likewise symmetric.

As for the rest, the clamping and spreading device 94 operates like the clamping and spreading device 10.

Figure 7:
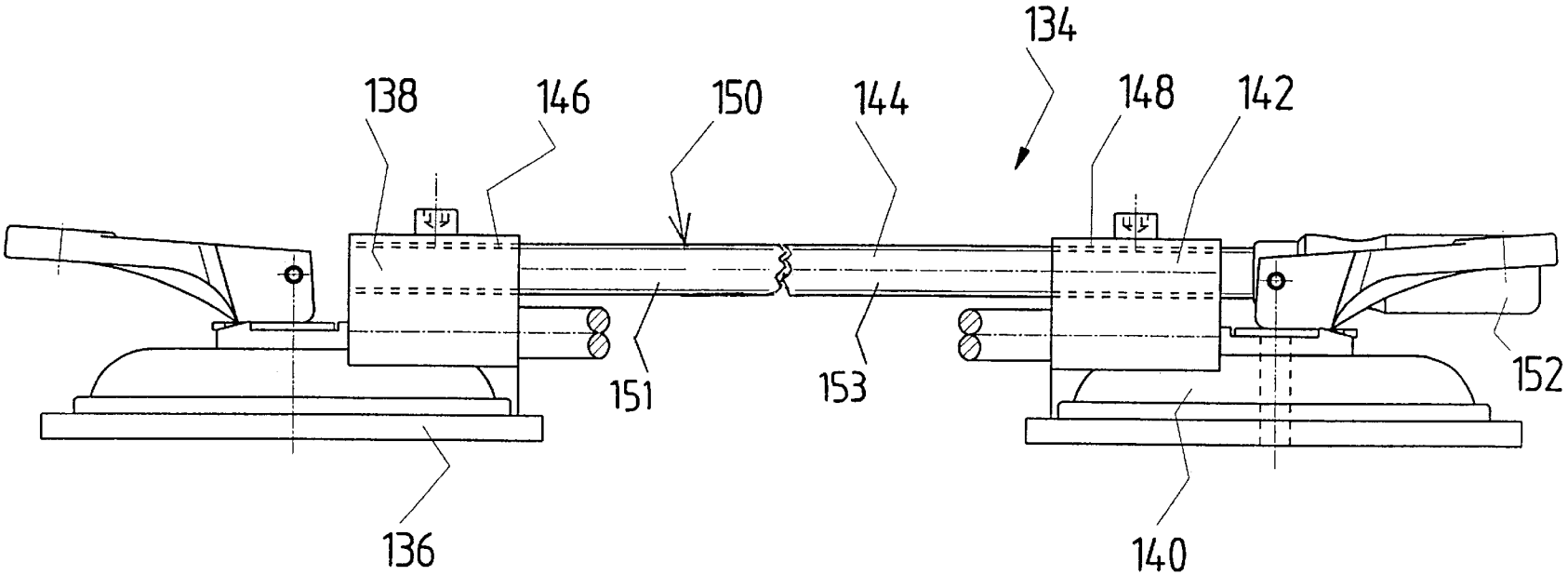
FIG. 7 shows a schematic sectional view similar to FIG. 6 of a third embodiment of an inventive clamping and spreading device.

In a third embodiment, which is shown in FIG. 7 and designated as a whole as 134, a first guide bracket 138 is again fixed on a first holder 136 and a second guide bracket 142 on a second holder 140. Corresponding guide rails are designed and arranged as explained on the basis of the second embodiment 94.

The two holders 136 and 140 are connected to one another by means of the guide brackets 138 and 142 via a rigid continuous spindle 144, wherein this spindle 144 is mounted on the first guide bracket 138 so as to be rotatably displaceable and is mounted on the second guide bracket 142 so as to be rotatably displaceable. For this purpose, the two guide brackets 138 and 142 have respective internal threads 146, 148, in which a two-part external thread 150 of the spindle 144 engages with a first threaded section 151 and a second threaded section 153. The spindle 144 is rotatably mounted on the guide brackets 138 and 142. The pairs of threads 146, 151 and 148, 153 are designed such that when the spindle 144 is turned an oppositely directed displacement movement is brought about, i.e. the two holders 136 and 140 are moved towards one another or are moved away from one another. In the case of a symmetric configuration of the pairs of threads 146, 151 and 148, 153 the relative movement is, in particular, symmetric.

In this respect, it may be provided for the spindle 144 to have an extension towards the outside, on which a handle 152 is arranged, in order to be able to cause the spindle 144 to rotate in a simple manner.

As for the rest, the clamping and spreading device operates in accordance with the third embodiment 134 as described above.

What is claimed is:

1. Clamping and spreading device for the relative movement of two workpieces having surfaces lying essentially parallel to a common plane, comprising:

a first holder being fixable on a surface of a first workpiece, and a second holder being fixable on a surface of a second workpiece, said first holder being movable relative to said second holder, and a guiding device via which the first holder and the second holder are connected to one another so as to be displaceable, said guiding device comprising:

at least two spaced guide rails, the first and second holders being guided for displacement relative to one another via said guide rails, and an actuating element not only mounted on the first holder so as to be movable but also mounted on the second holder so as to be movable, said movement of the first holder relative to the second holder being actuatable via said element.

2. Device as defined in claim 1, wherein the actuating element is mounted on the first holder so as to be one of rotatable or rotatable and displaceable relative to the first holder.

3. Device as defined in claim 1, wherein the actuating element is mounted on the second holder so as to be rotatable and displaceable relative to the second holder.

4. Device as defined in claim 3, wherein as a result of a rotary actuation of the actuating element the second holder is movable towards the first holder or away from the first holder depending on the direction of rotation.

5. Device as defined in claim 1, wherein the distance between the two holders is continuously variably adjustable via the actuating element.

6. Device as defined in claim 1, wherein a specific distance between the two holders is determined via a specific position of the actuating element.

7. Device as defined in claim 1, wherein the actuating element comprises a spindle extending between the two holders.

8. Device as defined in claim 7, wherein the spindle is rotatably mounted and being non-translational with respect to the first holder.

9. Device as defined in claim 1, wherein the actuating element comprises a sleeve arranged so as to be rotatable on one holder or between the two holders, at least one holder being displaceable in relation to said sleeve.

10. Device as defined in claim 9, wherein the holder or holders have a respective, non-rotatable spindle for engaging the sleeve, said sleeve being rotatable with respect to said holder or holders.

11. Device as defined in claim 1, wherein the actuating element is provided with at least one threaded section engaging in a corresponding threaded section of an associated holder for the displaceable guidance of this holder.

12. Device as defined in claim 1, wherein at least the second holder is provided with an internal thread for engaging in an external thread of the actuating element.

13. Device as defined in claim 1, wherein the actuating element is provided with a handle.

14. Device as defined in claim 13, wherein the handle is arranged at one end of the actuating element outside an intermediate area between the two holders.

15. Device as defined in claim 13, wherein the handle is arranged in the intermediate area between the two holders.

16. Device as defined in claim 11, wherein a first threaded section of the first holder or the actuating element and a second threaded section of the second holder or the actuating element are designed such that the two holders are displaceable relative to one another during rotation of the actuating element.

17. Device as defined in claim 1, wherein a guide rail is provided with an end stop.

18. Device as defined in claim 1, wherein the first holder and the second holder each have a guide bracket, the guide rails being guided or fixed on said guide brackets.

19. Device as defined in claim 18, wherein the guide brackets of the two holders are of the same design.

20. Device as defined in claim 18, wherein a guide bracket is designed with respect to its external configuration to be symmetric to a longitudinal axis of the device.

21. Device as defined in claim 18, wherein a guide bracket is designed such that the guide rails are located beneath the actuating element with respect to a holding plane facing the workpiece surface.

22. Device as defined in claim 1, wherein a spindle is mounted as actuating element on the first guide bracket of the first holder and the second guide bracket of the second holder.

23. Device as defined in claim 1, wherein the guide rails are fixed on the first holder.

24. Device as defined in claim 1, wherein the spaced guide rails are arranged in the area of a transverse end of a guide bracket.

25. Device as defined in claim 1, wherein the actuating element is mounted between the guide rails parallel to them.

26. Device as defined in claim 1, wherein a lever for compensating for differences in the levels of the workpieces is guided for displacement on a guide rail.

27. Device as defined in claim 26, wherein the lever is pivotable with a contact surface in the direction of the surfaces of the workpieces.

28. Device as defined in claim 27, wherein in a compensation position of the lever the contact surface is essentially located in a plane defined by the two holders.

29. Device as defined in claim 27, wherein the lever has a free space on its contact surface.

30. Device as defined in claim 1, wherein a holder comprises a vacuum suction device.

* * * * *